US009650842B2

(12) United States Patent
Carlsen et al.

(10) Patent No.: US 9,650,842 B2
(45) Date of Patent: May 16, 2017

(54) FORCE ELEMENT ARRANGEMENT AND METHOD

(75) Inventors: Hans-Paul Carlsen, Notodden (NO); Tor-Øystein Carlsen, Kongsberg (NO); Olav Inderberg, Kongsberg (NO)

(73) Assignee: FMC Kongsberg Subsea AS, Kongsberg (NO)

( * ) Notice: Subject to any disclaimer, the term of this patent is extended or adjusted under 35 U.S.C. 154(b) by 1558 days.

(21) Appl. No.: 12/735,759

(22) PCT Filed: Feb. 13, 2009

(86) PCT No.: PCT/NO2009/000054

§ 371 (c)(1), (2), (4) Date: Nov. 4, 2010

(87) PCT Pub. No.: WO2009/102220

PCT Pub. Date: Aug. 20, 2009

(65) Prior Publication Data

US 2011/0048727 A1 Mar. 3, 2011

(30) Foreign Application Priority Data

Feb. 13, 2008 (NO) ..... 20080778

(51) Int. Cl.

| | |
|---|---|
| ***E21B 17/01*** | (2006.01) |
| ***B23P 11/00*** | (2006.01) |
| ***E21B 19/00*** | (2006.01) |

(52) U.S. Cl.

CPC ..... *E21B 17/017* (2013.01); *E21B 19/002* (2013.01); *Y10T 137/0402* (2015.04)

(58) Field of Classification Search

USPC ..... 166/343, 345, 346, 350, 355, 359, 367; 405/224.2–4

See application file for complete search history.

(56) References Cited

U.S. PATENT DOCUMENTS

| | | | | |
|---|---|---|---|---|
| 3,523,578 | A * | 8/1970 | Crain et al. | 166/359 |
| 3,984,990 | A * | 10/1976 | Jones | 405/224.2 |
| 4,489,962 | A * | 12/1984 | Caumont et al. | 285/263 |
| 4,516,881 | A | 5/1985 | Beynet et al. | |
| 4,593,941 | A | 6/1986 | Whightsil, Sr. | |
| 4,662,785 | A * | 5/1987 | Gibb et al. | 405/195.1 |
| 4,854,781 | A * | 8/1989 | Sparks et al. | 405/224.4 |
| 4,856,827 | A * | 8/1989 | Delamare | 285/268 |
| 4,911,483 | A | 3/1990 | Delamare | |
| 5,951,061 | A | 9/1999 | Arlt, III et al. | |
| 7,559,723 | B2 * | 7/2009 | Mohr | 405/195.1 |
| 2004/0031614 | A1 * | 2/2004 | Kleinhans | 166/355 |
| 2008/0031692 | A1 * | 2/2008 | Wybro et al. | 405/224.4 |

FOREIGN PATENT DOCUMENTS

GB 2 156 401 A 10/1985

* cited by examiner

*Primary Examiner* — James G Sayre

(57) ABSTRACT

The present invention relates to a riser joint for a riser with a joint connecting two parts of a riser where the two parts are allowed angular displacement. According to the invention the riser joint comprises means for connection to the two parts of the riser at a distance from the joint, and means for adding a force between the two parts. The invention also relates to a method for reducing bending moments in a riser at a connection between the riser and a subsea installation.

13 Claims, 11 Drawing Sheets

FIG. 6
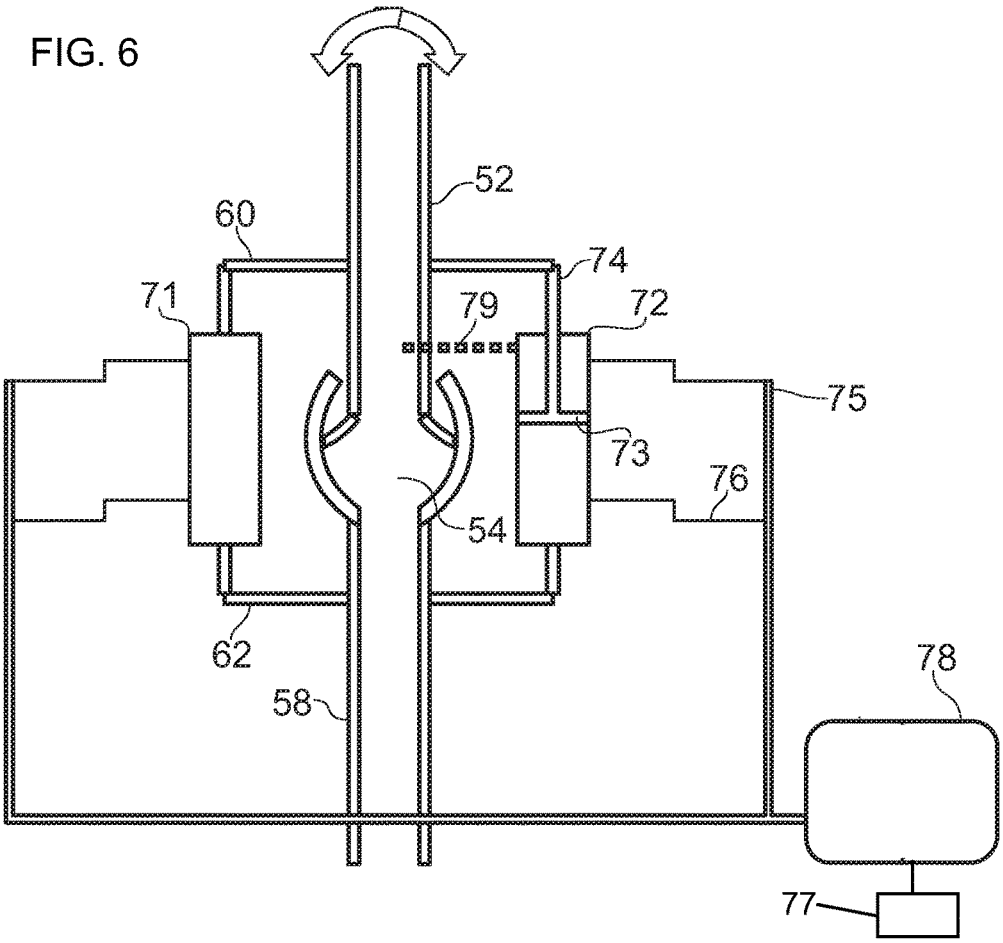
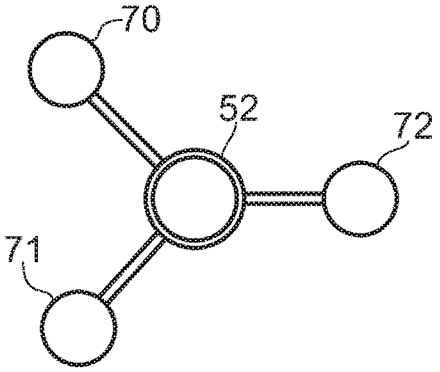
FIG. 6A

Fig. I 2.12 Time variation of the bending moment acting on the wellhead of a 150-m-long riser (RAO 16,9817) with different types of Flexjoint connections

FORCE ELEMENT ARRANGEMENT AND METHOD

BACKGROUND OF THE INVENTION

The present invention relates to a force element arrangement in relation to a riser joint and method for reducing bending moment in a riser at the connection point to a subsea installation, and more specifically to a riser having a flexible joint.

During subsea hydrocarbon extraction a riser is utilized to establish a conduit between a floating vessel and a subsea wellhead. Due to the fact that the riser at one end is fixed to the structure on the seabed and at the other end to a vessel that is under the influence of wind and waves, the riser is exhibiting stresses as the vessel moves. The riser is held in tension from the vessel and this will result in bending stresses in the riser as the vessel moves. To minimize these bending stresses the riser is equipped with a flex joint and or possibly a bend restrictor at the wellhead. A bend restrictor will resist bending and avoid point stresses at the connector, but will not reduce the bending moment as such. An example of a flex joint as used in the industry is shown in U.S. Pat. No. 5,951,061. Such a joint is designed with a certain stiffness to resist bending and, when bending occurs, to force realignment of the riser back to a neutral position.

A constant bending stress in itself will normally not damage the wellhead since the connector and the wellhead is designed to withstand these forces. However, the bending may be cyclic, due to vessel movements, and these cycles may result in fatigue problems at the wellhead.

In FIG. 1 there is shown a prior art riser system for use in well completions and workover operations. A well 10 has been drilled from the seabed 12 into the earth and completed in the normal manner, capped with a wellhead and subsea Christmas tree 14. A BOP or lower riser package (LRP) 16 is locked onto the Christmas tree 14. An emergency disconnect (EDP) 18 is locked to the LRP. Above the EDP there is normally arranged a stress joint 20 that will handle bending moments in the riser. The stress joint 20 may be in the form of a bending restrictor. At the lower end of the riser there is also a safety joint or weak link 22. The riser 24 itself consists of a number of pipes that are screwed or otherwise locked together to form a pipe string as is well known in the art. At the top of the riser there is a telescopic joint 26. In the drawing the telescopic joint is shown in its collapsed position. The riser 24 is held in tension using a tension system 28 in the normal manner. A surface flow tree is attached to the top of the riser and held in tension using the heave compensator (not shown). The vessel has a cellar deck 32 and a drill floor 34. All operations are conducted on the drill floor.

SUMMARY OF THE INVENTION

According to the invention the above mentioned problems are reduced and or eliminated by equipping the riser with a joint, a riser with such a joint and a method as defined in the attached claims.

According to the invention there is provided a joint for use in connection with a riser, as defined. The joint will in an installed position form part of the riser, either between two riser sections or between an installation and the riser. The joint has when used in a riser a flow passage through the joint connectable to the flow passage in a riser. The joint comprises flexible means allowing a first end of the joint to be lateral displaced relative a second end of the joint. Such flexible means may be configured in different ways as by having a normal flex joint, possibly a ball joint, a bellow joint or also having a joint comprising a pipe segment which allows a first end of the pipe segment to form an angular displacement in relation to an opposite end of the pipe segment, i.e. a pipe segment which allow bending of the pipe segment, or other joints allowing one part of the riser to move relative the other riser part. The joint is also configured to provide the tension forces in the riser are transferred through the joint, and possibly through the flexible means. The joint therefore should be able to take tension forces and preferably internal pressure of a fluid transferred through a passage through the joint.

According to the invention the riser joint further comprises force means connected to both first and second end. These force means are configured to add a force to the one end when it is moved out of the neutral position. The force added is applied in the same direction as the direction of the movement of the one en out of the neutral position. The force will try to bend the joint further out from a neutral position.

With other words the joint according to the invention is adapted to be connected to a riser for forming part of a riser, possibly as a joint between two riser parts and the joint will then allowed angular displacement of the two riser parts relative each other in the joint due to the flexible means within the joint. According to an aspect the joint may comprise a first anchoring point located adjacent to the first end and a second anchoring point located adjacent a second end, where both anchoring points are being laterally displaced from a joint axis in a neutral position of the joint. The force means are configured to apply a force between the anchoring points, to laterally deflect the one end of the joint away from the joint axis. With a joint axis one should understand an axis running from a center the one end to the centre of the second end. When there is a flow passage through the joint the axis may run from the center of a first end of the passage, at the first end of the joint to the centre of the second end of the passage, at the second end of the joint.

According to an aspect the joint may comprise connection means for connection to a part of a riser relatively stationary and connected to a seabed installation and connection means for connection to a part of a riser allowed to move relative the seabed. By this the joint is connectable to two different riser parts, which will be joined the joint and thereby allowed relative movement between them. According to an aspect the joint and the force means are so configured that in a neutral position of the two parts of the riser the force means provides mainly equal forces around the circumference of the joint and in a non-neutral position provides a force on the two ends of the joint, which force will act to move the ends and the riser parts connected to the end in an installed state of the joint further away from the neutral position. The force element will thereby provide a "negative stiffness" to the joint Stiffness should be understood to be the resistance of an elastic arrangement to deflection or deformation by an applied force. An elastic arrangement will deform under stress, but return to original form. The force means in the joint according to the invention will add a force between the two ends, or the two parts of the riser in a an installed state, such that to move the two ends or parts back to the neutral position this force must be overcome, i.e. it acts as a negative stiffness for the joint or the arrangement, in relation to movements from the neutral position. When the joint forms a part of a riser, when one part of the riser moves out of the neutral position, or has an angled position in relation to the neutral position, the force means will act on the two ends of the joint and thereby on the parts of the riser and at least initially try to increase the angle the end or the part of the riser has formed with the neutral position.

In a neutral position the longitudinal axes of the two parts of the riser or the axes of the ends of the joint may be parallel. With an axis of an end is should be understood to be an axis substantially normal to the surface connectable to another element, or with a passage through the joint the axis of the passage at the end of the passage. It is also possible to envisage a neutral position where the part of the riser which is kept stationary in relation to the seabed, has a longitudinal axis which forms an angle with a vertical axis, and the longitudinal axis of the other riser part in a neutral position is mainly vertical. In such a situation the two different axes of the two parts of the riser, may in a neutral position with the joint connected to the two riser parts, form an angle between them. According to the invention the force means, possibly comprising several force elements arranged around the flexible means of the joint, will in this neutral position, when this is given, provide a force on the two parts of the riser, of the ends of the joint that is mainly equal around the circumference of the joint or riser and thereby keep the two riser parts or two ends of joint in this neutral position. It is when the relative position between the two riser parts or ends comes out of this neutral position that the force means provides a force trying to further move the two riser parts or ends out from the neutral position, thereby providing a negative stiffness to the connection between the two riser parts in the form of the joint according to the invention.

The additional force provided by the force means when the two riser parts are not in the neutral position must be overcome to move the riser parts or ends back to a neutral position. A riser extending between a subsea installation, fixed in relation to the seabed and a floating installation, moving with the changing conditions of waves, wind, will experience that the floating installation has movements in a horizontal direction. This will lead to an angled positioning of a part of a riser, since the subsea installation will not move. In such a condition a joint according to the invention in the riser will be moved from a neutral position, due to the horizontal movement of the floating installation. The force means of the joint according to the invention will then try to bend the joint further in the direction of the movement of the floating installation. This further bending of the joint will cancel out some of the bending moment induced by the horizontal movement of the floating installation in the riser, below the joint according to the invention, and then possibly in the subsea installation thereby extending the life of the subsea installation. Then when the floating installation moves back to its original position this movement will force the joint according to the invention back to its neutral position. The floating vessel and the riser part extending between the joint according to the invention and the floating vessel will have a large mass and therefore easily move the joint according to the invention back to its neutral position and then act against the force induces by the force means of the joint. The riser will normally also be connected to a tension system on the floating installation The floating installation may be a floating platform, a ship, vessel or similar.

According to the invention the joint in relation to the connection between the two riser parts, comprises a force means or a force element arrangement as described that induces bending forces to the connection between the two riser parts or between two ends of the joint, in such a manner that with an angle from the neutral position in the connection or between the two ends of joint the force means or element arrangement will trying to increase this angle. This will render the riser system wherein the joint is used in such a way that the resulting bending stresses at the connection to the subsea installation are reduced.

According to one aspect of the invention the force means or force element arrangement may comprise a system with at least one elastic element, as for instance at least one helical spring. The spring would in one embodiment be arranged in tension between the connecting means of the force element arrangement. In another embodiment the spring may be arranged in compression. There may be one spring arranged extending around the joint or at least three separate springs arranged around the circumference of the joint. There may alternatively be at least one elliptic shaped spring joint between two riser parts, in such an embodiment also forming the flexible means. The elastic elements or springs may be configured as linear or non-linear force inducing elements.

According to another aspect the force means may comprise a system with at least three fluid operated cylinders arranged around the circumference of the riser. According to this aspect there may be a control system regulating the fluid in the fluid operated cylinder in response to the relative position of the two riser parts or it may be configured as a passive system with an accumulator in the system. The hydraulic cylinders may be hinged to connection means attached to the ends of the joint and arranged with their axis of movement parallel to a fluid passage through the joint, perpendicular to the fluid passage through the joint or in an arrangement forming a mainly conical shape around the flexible means of the joint.

According to yet another aspect the force means may comprise a system with magnets arranged around the riser parts. In one embodiment these magnets may be electromagnets and there may be a source of electricity which is regulated in a control system in response to the relative position of the two riser parts, in another embodiment there may be permanent magnets or a combination.

According to an aspect of the invention the force means or force element arrangement may be formed as an integral part of the joint or as separate part removable attached to a riser joint. This gives the possibility of providing existing riser joint with force means to form a joint according to the invention.

One may have combinations of the features as mentioned above, another possibility is to form the joint with at least one permanently bended pipe segment between two swivels, where the swivels form connection means to the riser at the two ends of the joint. By having movements between the swivels and the bended pipe segments one allows and can regulate the angular relationships between the different parts of the joint and thereby the bending moments that occur in the joint, and thereby be adding a bending force to the joint as a consequence of angular deviation in the riser. The bended pip segments and swivels, forms in this embodiment the flexible means of the joint according to the invention. The swivels may be controlled by motors with crown wheels to control the movement of the bended pipe segment in relation to the rest of the riser, these elements are then forming the force means and these are connected to the ends of the joint through the swivels.

According to another aspect the force means comprising force inducing elements, as springs, cylinders, magnets etc may be arranged with a direction forming an angle with the passage through the joint, thereby arranged in a cone like manner around the joint. By having such a positioning of the force inducing elements one achieves a geared system. There is also the possibility of providing a joint with force means which are a combination of the different embodiments as described above.

The invention also relates to a riser between a floating installation and an installation fixed relative the seabed, comprising a joint according to the invention as described above.

The invention also relates to a method for reducing bending moments at the connection of a riser to a subsea installation.

BRIEF DESCRIPTION OF THE DRAWINGS

The invention will now be described with reference to the accompanying drawings where;

FIG. 6 is a drawing showing a second embodiment of the invention,

FIG. 6A is a top plan view of the embodiment of the invention shown in FIG. 6.

DETAILED DESCRIPTION OF THE INVENTION

Figure 1:
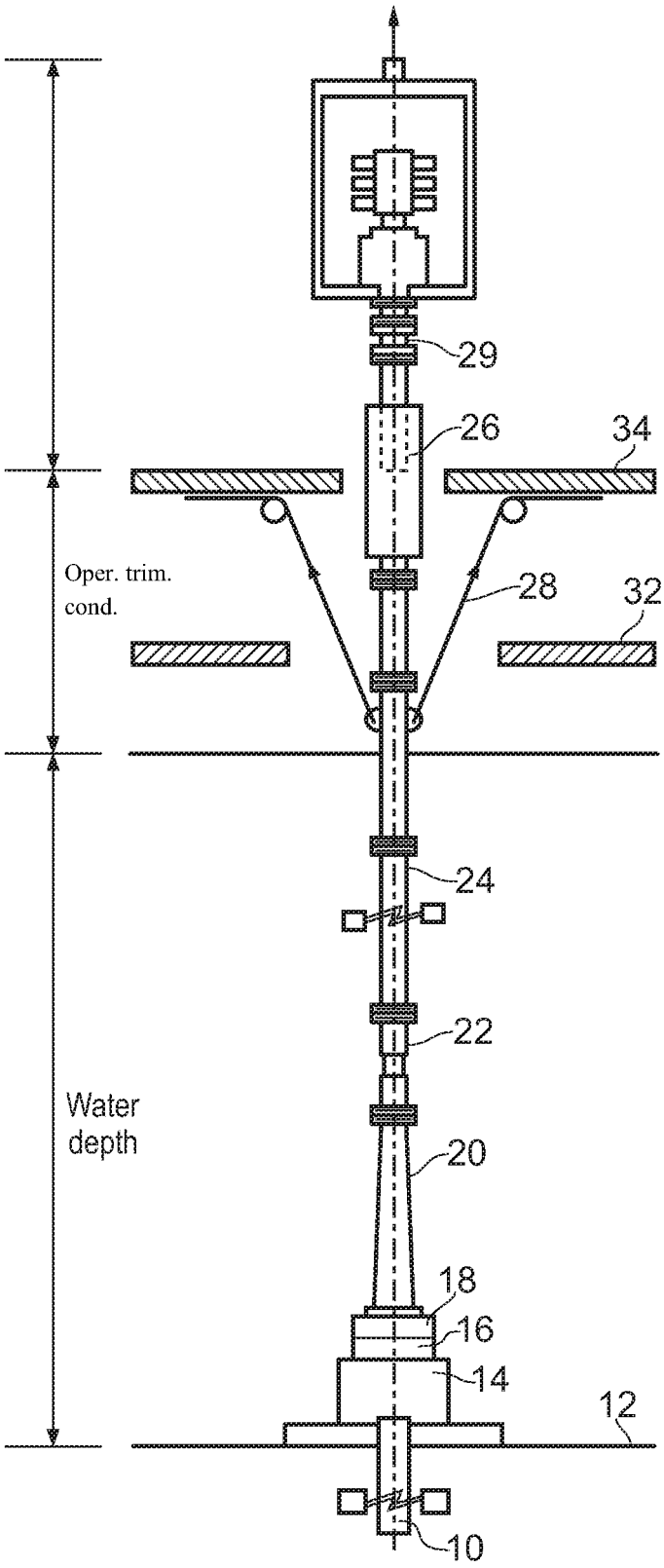
FIG. 1 is a drawing of a prior art riser system.
Figure 2:
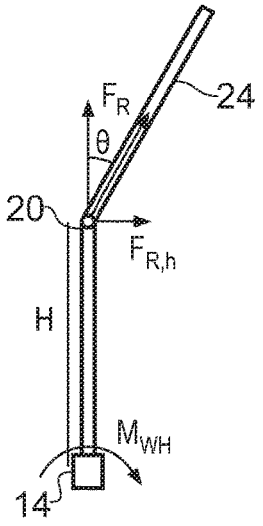
FIG. 2 is a sketch showing the forces acting on the riser.

In FIG. 2 is shown a simplified sketch of a part of the riser system as depicted in FIG. 1. A flex joint 20 is mounted between the riser 24 and wellhead 14. The flex joint is typically located at a height H from the wellhead 14 datum to the flex joint axis. The riser can also be said to comprise two parts joined at the flex joint. As can be seen from FIG. 2, when tension is applied to the riser, an upward force $F_R$ acts on the wellhead. When the riser is at an angle θ this force will split into a vertical and a horizontal component. As will be understood, when the riser is vertical the horizontal component is zero but as the angle increases the horizontal component will also increase. The horizontal component will result in a bending moment generated at the wellhead, as represented by the formula $$M_{WH}=F_{R,h}\times H+k_\theta\times\theta$$

where

Figure 3:
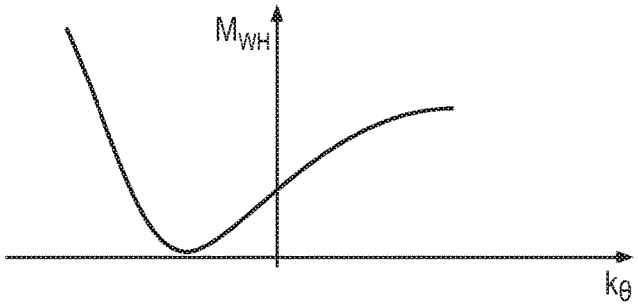
FIG. 3 is a diagram showing bending moments.

H: Height from wellhead datum to flex joint axis

θ: Global flex joint angle $F_R$: Riser tension at flex joint axis $F_{R,h}$: Horizontal component of $F_R$ $k_\theta$: Rotational flex joint stiffness FIG. 3 is a diagram of one solution to the above equation, showing the curve of the bending moments $M_{wh}$ as a result of varying the flex joint stiffness $k_\theta$. This shows that even when the flex joint stiffness $k_\theta$ is zero, which is an idealized joint with no friction or stiffness, there is still bending moment $M_{wh}$ acting on the wellhead, as can bee seen as the graph crosses the Y-axis in a distance from the X-axis. The bending moments on the wellhead will as indicated with the graph also with an increasing flex joint stiffness have an increasing value. The diagram also shows that the least moment on the wellhead is achieved if the stiffness in the joint between two parts of the riser is negative. This theoretical considerations shows that if it could be possible to design a flex joint with a negative "stiffness", the result will be an arrangement giving the least moment forces acting on the wellhead. There is a range of negative stiffness values for the flex joint stiffness $k_\theta$, which gives this desired effect on the wellhead. One can see this in the figure in that the graph has a dip close to a zero value for the bending moment at the wellhead, $M_{wh}$, for a negative value of the joint stiffness $k_\theta$. One should here also notice that with a negative flex joint stiffness $k_\theta$ which has a larger negative value, there will again be an increasing bending moment at the wellhead, as indicated in the graph. The challenge is to change cocking stiffness of a joint between two parts of a riser from positive to negative. This will reduce the overall dynamical/static bending moment on the wellhead during subsea operations.

Figure 4:
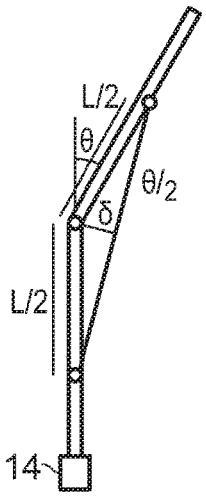
FIG. 4 is a sketch showing the principles of the invention.

This problem is solved according to the invention by providing a device which is creating a force that acts on the two riser parts connected by the joint that induces a negative stiffness in the joint between the two riser parts. In FIG. 4 there is shown a sketch of the principle behind the invention. A force creating element is attached between a point below and a point above the flex joint or with other words to the two different riser parts in a distance from the joint. The element will create a situation giving that if the bending angle is larger than zero the force element will try to increase the angle. The bending angle is an angle between the two riser parts, when these riser parts are moved out from a neutral position. This angular deviation of the one riser part in relation to the other riser part will be resisted by the vessel due to the tension system connected to the riser at the vessel and the result is that in this situation we have introduced a flex joint with a "negative" stiffness. This enables the flex joint to be designed with negative cocking stiffness and this will cancel out or reduce the influence of the bending moments as a result of the deviation of the riser parts relative each other., as shown in the formula below:

$$M_{FJ} = F\times\delta$$

$$\delta = \frac{L}{2}\times\sin\left(\frac{\theta}{2}\right)$$

$$F = P-\left(k\times L-k*L*\cos\left(\frac{\theta}{2}\right)\right) = P-k\times L\left(1-\cos\left(\frac{\theta}{2}\right)\right)$$

$M_{FJ}$: Bending moment generated by flex joint $F$: Spring force $\delta$: Distance from spring centre to flex joint rotational axis $\theta$: Global flex joint angle $L$: Length of spring in neutral flex joint position, i.e. $\theta = 0$ (changeable)

-continued $P$: Preload in spring (changeable)

$k$: Spring tensile stiffness (changeable)

Figure 5:
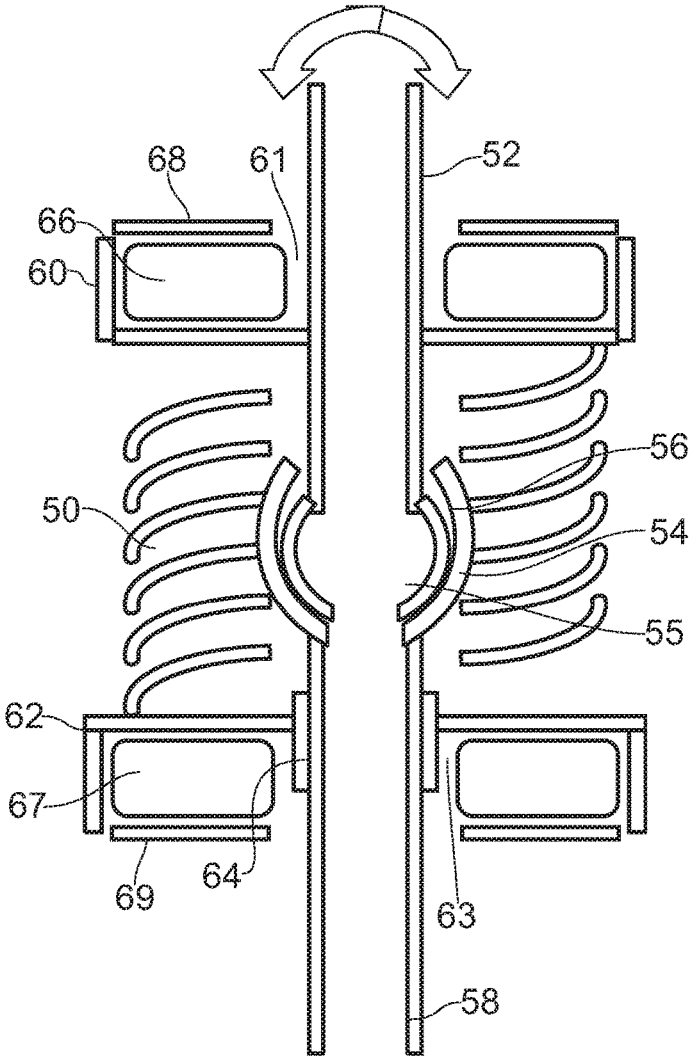
FIG. 5 is a drawing showing a first embodiment of the invention.

FIG. 5 shows a first embodiment of the invention where the force means or force element arrangement for bending the riser comprises a mechanical spring 50. In the description below there is used the phrase force element arrangement alternately with force means. A flex joint is known to those skilled in the art and is therefore only represented in principle in the FIG. 5. The flex joint may for example be of the kind described in U.S. Pat. No. 5951061 comprising a ball shaped member 55 that moves against a spherical seat 56 and having rubber elements that take up the forces when bending occurs. The upper part 52 may be connected to the riser pipe 24 attached to a floating vessel and thereby follow the movement of the vessel, while the lower part 58 may be attached to the stress joint 20 shown on FIG. 1, and thereby kept relatively still in relation to the seabed. However, any kind of flexible joint may be used between the two parts of the riser that should be allowed to form an angular deviation between them. By angular deviation one should understand that there is an angular deviation between the longitudinal axes of the two riser parts, or the riser part attached to the vessel and the part of the fluid conduit from the well and up to the flex joint. This last part of the fluid conduit will also form a part of the riser from the well to the vessel. A first shoulder or spring holder 60 is attached to the first or upper part 52 of the riser and a second shoulder or spring holder 62 is attached to the second or lower part 58. In the figure there is shown that the position of the lower shoulder 62 can be adjusted relative the second part 58 by a nut arrangement 64. It is possible to arrange also the first shoulder 60 adjustable connected to the first part. It is also possible to arrange both shoulders 60, 62 adjustable connected to their respective parts 52,58 of the riser. This enables the spring to be pretensioned according to the desired force on the specific flex joint to easily adjust the force for the specific use. The shoulders 60, 62 are formed by annular shaped shoulders extending in a radial direction relative the riser parts. There is in these shoulders 60, 62 also arranged a groove 61, 63. As shown in the figure these grooves 61, 63 of the respective two shoulders 60, 62 are facing away from each other and thereby also facing away from the other riser part compared with the one they are attached to. It is also possible to envisage an opposite configuration where the grooves are facing each other. In the spring holders or shoulders there are arranged hydrostatic suspensions 66, 67 respectively. The hydrostatic suspensions each consist of a ring-shaped cylindrical flexible element, for example made by rubber. The interior of this flexible element is filled with a fluid, preferably an incompressible fluid. The flexible element forming the hydrostatic suspensions 66,67 is positioned in the grooves 61,63 of the respective shoulders 60,62. There are arranged end parts 68, 69 of the spring 50 in the form of disk shaped elements which are supported on the flexible elements 66 and 67. The end parts 68,69 are thereby allowed to have a angular position other than transverse to a longitudinal axis of the part of the riser and thereby also an angular position other than parallel with a main extension of the shoulders. The shoulders 60, 62 are fixed to have a mainly rectangular orientation in relation to a longitudinal axis of the riser part to which they are attached.

The spring is tensioned according to the desired function and when the upper part 52 moves out of alignment the axis of the spring will also move out of alignment with the riser. This creates the uneven force that will tend to pull the riser further out of alignment. A stop may be introduced to limit the bending angle, In an alternative the spring may be replaced with a bi-stable rubber element having the same function.

FIGS. 6 and 6A show a second embodiment of the arrangement for providing forces to the joint. Similar parts are given the same numbers as on FIG. 5. Between the two shoulders 60,62 there are arranged a number of hydraulic cylinders 70, 71, 72 having pistons such that the piston 73 is connected to a rod 74 which is attached to one shoulder, in this case shoulder 60. The cylinder is, in this case, attached to shoulder 62. The piston 73 is reciprocally movable in cylinder 72 thus limiting the cylinder into two chambers. Each chamber is connected to a fluid line 75 and 76 for supplying fluid under pressure to one or the other chamber, for thereby regulating the force from the cylinder arrangement on the flexible joint. The fluid lines are connected to a source of pressurized fluid 77 and the flow to the different chambers of the different cylinders in the cylinder arrangement is controlled by a control unit 78. The system also includes sensors for measuring the global riser angle θ as well as pressure and temperature transmitters as is common in control systems. The arrangement function such that the angle size and direction is measured and when the riser starts bending the control unit will direct pressurized fluid into the chamber above the piston to force an increase of the bending angle.

The piston and cylinders are preferably attached to the shoulders with flexible joints to avoid excessive bending.

The system is shown having three cylinders equally disposed around the riser but the number may be any that will achieve the desired result. Also, it will be obvious to a person skilled in the art that the piston and cylinder can be otherwise arranged, i.e. that the piston may be attached to the lower shoulder 62 and the cylinder to the upper shoulder 60. It should also be obvious that the pressurized fluid can be directed and distributed to more than one cylinder so that the increase in angle can be achieved. As indicated in the figure a line 79 may be connected between the hydraulic cylinders 72 and the internal bore 54 of the riser through the joint. By this one may pressure compensate the force element arrangement for the pressure within the riser and thereby have the possibility of regulating the force element arrangements and the forces from this arrangement on the riser parts, independent of the pressure within the internal bore 54.

Figure 7:
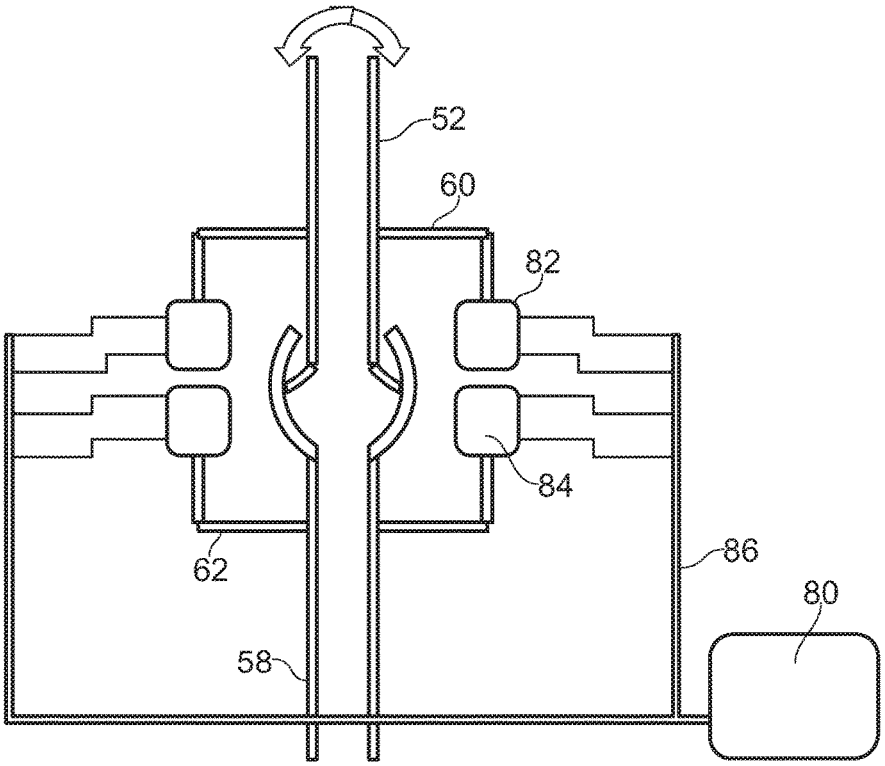
FIG. 7 is a drawing showing a third embodiment of the invention.

In FIG. 7 there is shown a third embodiment of the invention. In this case the desired function is achieved by using electromagnets. Again, any number of magnets can be used, distributed evenly around the joint. Each electromagnet consists of a positive 82 and negative 84 magnets, each attached to, respectively, the upper and lower shoulder 60, 62. A cable 86 extends from a power unit 80 to the electromagnets. When power is applied to the electromagnets they will be attracted to each other and, as is known in the art, the distances between the magnets are proportional to the attraction. The system is therefore of such a configuration that when the riser starts bending to one side, the magnet(s) on that side will seek to move closer together and thereby try to increase to bending of the flexible joint. This will increase the power of attraction and tend to increase the angle. It should also be noted that by changing the polarity of the magnets it will be possible to lock the joint in the stable (e.g. aligned) configuration.

Figure 8:
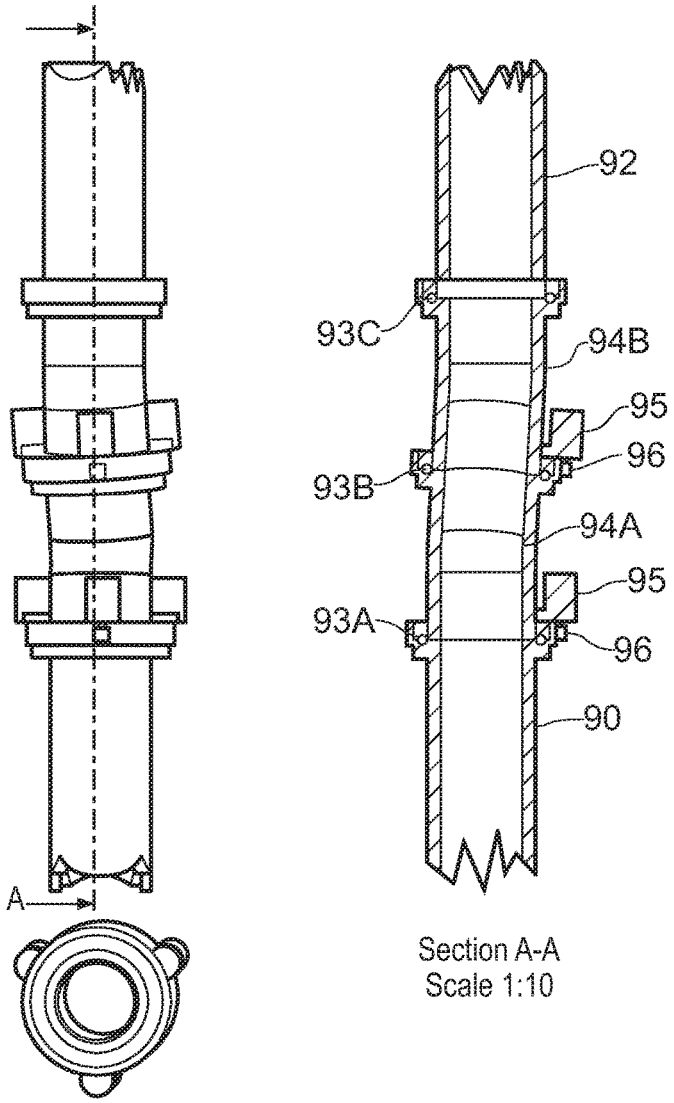
FIG. 8 is a drawing showing a fourth embodiment of the invention.

In FIG. 8 there is shown a fourth embodiment of the invention. In this embodiment a first riser segment 90 is connected to the joint according to the invention through a first swivel means 93A. At the opposite side of this swivel means 93A there is connected a first bent pipe segment 94A. A first end of the first bent pipe segment 94A will not be aligned with a second end of the first bent pipe segment 94A since this pipe segment is bent. Via a second swivel means 93B a second bent pipe segment 94B is connected to the first bent pipe segment 94A. The second bent pipe segment 94B is connected to a second riser segment 92 via a third swivel means 93C. The relative movement between the different bent pipe segments 94A, 94B is controlled by motors 95 with crown wheels 96. Through the controlled movement of the swivel means one achieves the induced bending force in the joint.

Figure 9:
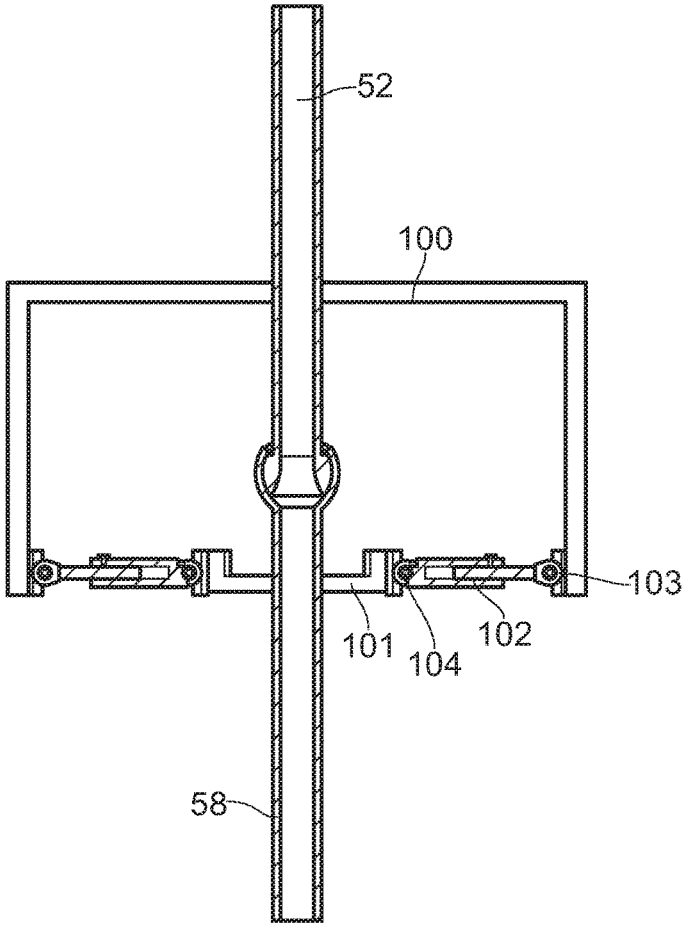
FIG. 9 is a drawing showing a fifth embodiment of the invention

In FIG. 9 there is shown a fifth embodiment of the invention. This embodiment is similar to the embodiment in FIG. 6. A difference in this embodiment is that the cylinders/piston rod 102 are arranged with an extension axis transverse to an axis of the joint in a neutral position, and with hinged connection 104,103 connected between a first arm 101 and a second, mainly L-shaped arm 100 with a distal end of the L-shape arranged mainly radial outside the first arm 101. Each arm 100,101 is connected to a respective part 52,58 of the joint.

Figure 10:
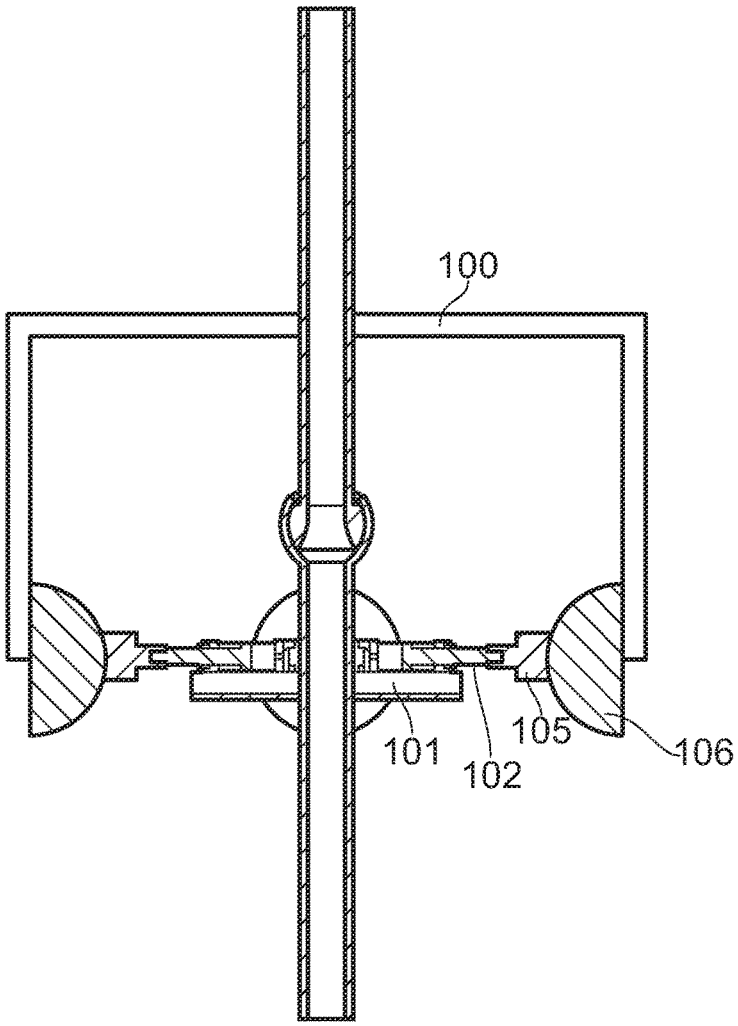
FIG. 10 is a drawing showing a sixth embodiment of the invention.

A similar system is shown in the sixth embodiment as shown in FIG. 10, but in this embodiment the piston rod 102 is connected to a bearing arrangement 105 running on a spherical surface 106.

Figure 11:
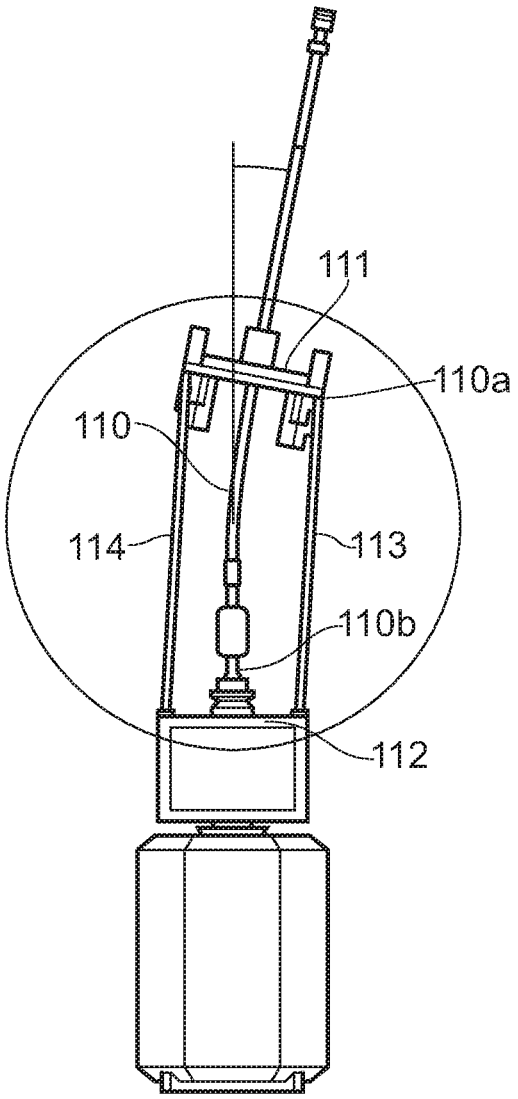
FIG. 11 is a drawing showing a seventh embodiment of the invention.

In FIG. 11 there is shown a seventh embodiment of the invention. In this embodiment the flexible means of the joint between the two ends are formed by a flexible pipe segment 110 instead of a ball joint or prebended pipe segments as shown in the other embodiments. The flexible pipe segment 110 is connected frame elements, 111 and 112, one on each end of the joint. The force means 113,114 are in this embodiment shown to be cylinder/piston arrangements. It is however possible to envisage the flexible pipe segment 110 with the other possible force means arrangements as described in relation to embodiment with the ball joint solution.

Figure 12:
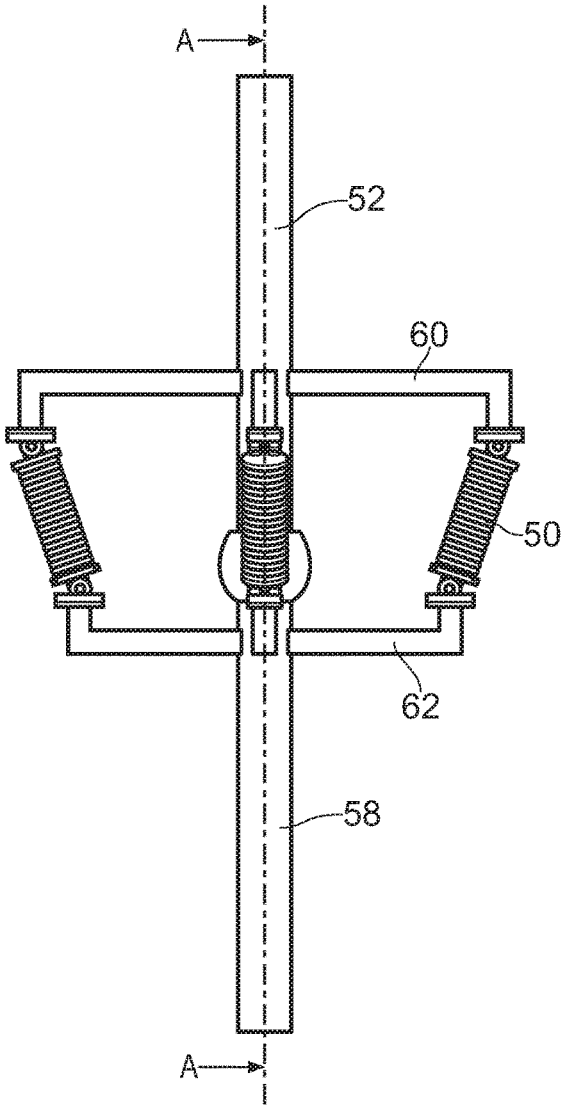
FIG. 12 is a drawing showing an eight embodiment of the invention.

In FIG. 12 there is shown a different aspect of the invention. In this embodiment the force means, in the form of helical springs 50, are positioned at one end of the force means closer to a centre axis of the joint than at the other end of the force means. This will give a gearing of the force in this system dependent on the lateral displacement of the end of a first part 52 of the joint in relation to an end of a second part 58 of the joint. Such a positioning of the force means are also possible with the other different force means as described in relation to the other embodiments.

Figure 13:
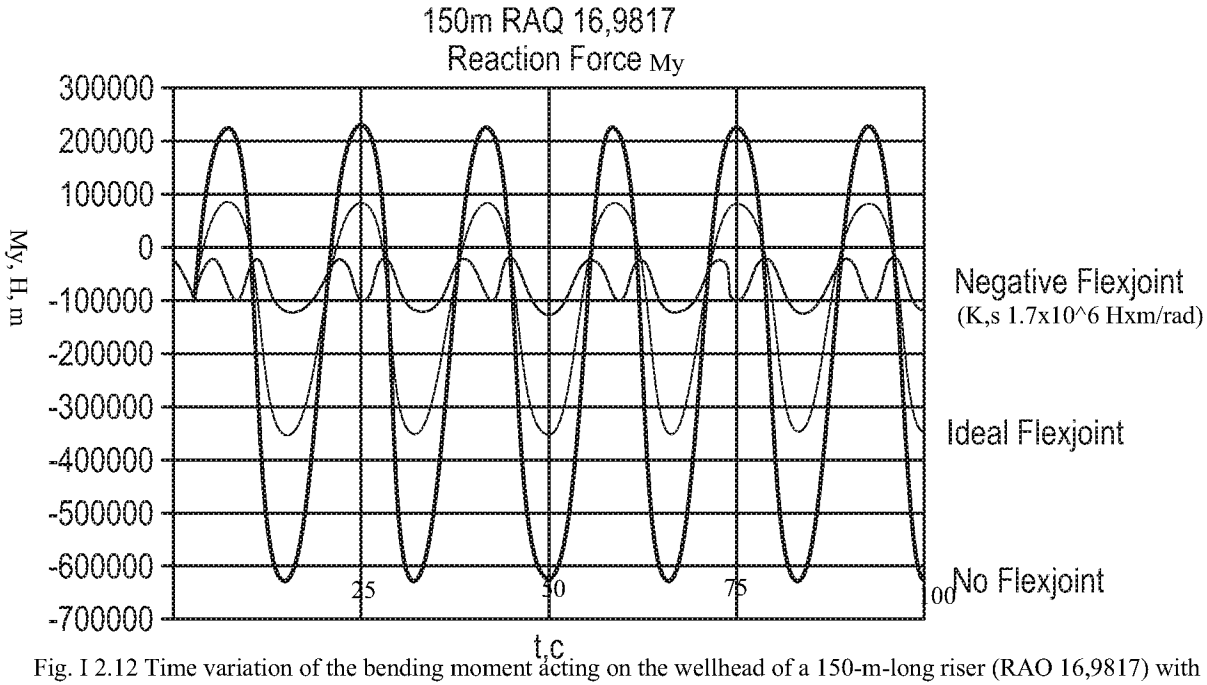
FIG. 13 is a diagram showing bending moment variations on the wellhead with three different configurations of a riser.

In FIG. 13 there is shown a diagram showing the results in the form of graphs of a calculation of the time variation of the bending moment acting on a wellhead of a 150 meter long riser (RAO 16,9817) with different types of flexible riser joints. There are three curves shown in this diagram, one where there is no flex joint in the riser, which is the graph with the largest variations in bending moments. The second graph is with a theoretical ideal flex joint, showing less bending moments than with no flex joint. The third graph is a riser with a joint according to the invention, described as a negative flex joint, since the joint will try to increase the bending when the joint first bends. As one can see the bending moments are not zero but the amplitudes are reduced significantly.

The invention has now been explained with several embodiments. A skilled person will understand that there may be made alterations and modifications to these embodiments that are within the scope of the invention as defined in the attached claims. For example it may be desirable to have a locking function to lock the system so that it will behave as a stiff rod, i.e. turning the flex joint into a stiff joint. It may also be desirable to use a type of flex joint that does not resist bending, such as a ball joint.

The invention claimed is:

1. A riser joint for use in connection with a riser, the joint comprising:

first and second ends;

a flexible connection between the first and second ends which is configured to allow the first end to be laterally displaced relative to the second end; and force means connected to both the first and second ends for generating a force on one of the ends when that end is moved out of a neutral position;

wherein the force is applied in the same direction as the direction of movement of the one end out of the neutral position.

2. The riser joint according to claim 1, further comprising:

a first anchoring point located adjacent to the first end; and a second anchoring point located adjacent to the second end;

both anchoring points being laterally spaced from a joint axis in a neutral position of the joint;

wherein the force means are configured to apply a force between the anchoring points to laterally deflect the one end of the joint away from the joint axis.

3. The riser joint according to claim 1, further comprising a first shoulder connected to the first end and a second shoulder connected to the second end, wherein the force means are connected to the two shoulders.

4. The riser joint according to claim 3, wherein the force means are connected to at least one of the shoulders with a hinged connection.

5. The riser joint according to claim 3, wherein at least one of the shoulders is adjustably connected to its corresponding end.

6. The riser joint according to claim 1, wherein the force means comprises one selected from the group consisting of a mechanical system, a hydraulic system, a magnetic system and an electric system.

7. The riser joint according to claim 1, wherein the force means comprises a cylinder arrangement which includes at least three pistons connected to one of the ends and at least three cylinders connected to the other of the ends, and fluid lines connected between the cylinder arrangement, a reservoir of fluid and a control unit.

8. The riser joint according to claim 1, wherein the riser extends between a floating installation and an installation fixed relative the seabed.

9. The riser joint according to claim 8, wherein the riser is connectable to a tension system arranged on the floating installation.

10. A method for reducing bending moments in a riser at a connection between the riser and a subsea installation, the riser being connected to a tension system at a floating vessel, the method comprising providing a riser joint between two parts of the riser which riser joint in a neutral position provides mainly equal forces around the circumference of the riser and which with a deviation from the neutral position will induce a force on the two parts which will act against the return of the two parts to the neutral position.

11. The method according to claim 10, further comprising providing the riser joint with a cylinder arrangement and regulating a supply of fluid to the cylinder arrangement to regulate the force acting on the two parts of the riser.

12. A riser joint for connecting a first part of a riser to a second part of the riser, the riser joint comprising:

a first end which is connected to the first part;

a second end which is connected to the second part;

a flexible connection between the first and second ends which is configured to allow the first end to move laterally relative to the second end; and a force element which is connected between the first and second ends and which, when the first end moves relative to the second end, generates a force on the first end which acts in the same direction as the direction of movement of the first end relative to the second end.

13. The riser joint according to claim 12, wherein the force element comprises a plurality of hydraulic cylinders, each of which includes a piston that is connected to one of the first and second ends and a cylinder that is connected to the other of the first and second ends.

* * * * *